US010438481B2

(12) United States Patent
Yi et al.

(10) Patent No.: US 10,438,481 B2
(45) Date of Patent: Oct. 8, 2019

(54) INTEGRATED REMOTE CONTROL DEVICE AND COMPUTER READABLE RECORDING MEDIUM STORING REMOTE CONTROLLING METHOD USING THE SAME

(71) Applicants: Hyundai Motor Company, Seoul (KR); Kia Motors Corporation, Seoul (KR)

(72) Inventors: Kichang Yi, Suwon-si (KR); Hui Sung Lee, Gunpo-si (KR); Hyoung Shin, Yongin-si (KR); Youngwook Song, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 10 days.

(21) Appl. No.: 15/662,078

(22) Filed: Jul. 27, 2017

(65) Prior Publication Data

US 2018/0165950 A1 Jun. 14, 2018

(30) Foreign Application Priority Data

Dec. 13, 2016 (KR) ..... 10-2016-0169892

(51) Int. Cl.
*G08C 19/00* (2006.01)
*G08C 17/02* (2006.01)

(52) U.S. Cl.
CPC ..... *G08C 19/00* (2013.01); *G08C 17/02* (2013.01); *G08C 2201/20* (2013.01); *G08C 2201/92* (2013.01)

(58) Field of Classification Search
CPC .... G08C 19/00; G08C 17/02; G08C 2201/20; G08C 17/2201; G08C 17/92
See application file for complete search history.

(56) References Cited

U.S. PATENT DOCUMENTS 5,235,328 A * 8/1993 Kurita ..... H03J 1/0025 340/12.28
8,035,756 B1 * 10/2011 Grove ..... H04N 21/42213 348/734
2004/0070491 A1 * 4/2004 Huang ..... G08C 17/02 340/10.5
2006/0092038 A1 * 5/2006 Unger ..... G08C 17/00 340/4.41

FOREIGN PATENT DOCUMENTS

KR 10-1583831 B1 1/2016
KR 10-1601109 B1 3/2016

* cited by examiner

*Primary Examiner* — Nabil H Syed
(74) *Attorney, Agent, or Firm* — Morgan, Lewis & Bockius LLP

(57) ABSTRACT

An integrated remote control device may include function modules corresponding to control objects detachably mounted thereon and a computer readable recording medium storing a remote controlling method using the same, wherein the integrated remote control device can improve convenience of a user by controlling a plurality of control objects using one remote control device and by adding the control objects in a simple way.

10 Claims, 6 Drawing Sheets

INTEGRATED REMOTE CONTROL DEVICE AND COMPUTER READABLE RECORDING MEDIUM STORING REMOTE CONTROLLING METHOD USING THE SAME

CROSS-REFERENCE TO RELATED APPLICATION

The present application claims priority to Korean Patent Application No. 10-2016-0169892 filed on Dec. 13, 2016, the entire contents of which are incorporated herein by reference, the entire contents of which is incorporated herein for all purposes by this reference.

BACKGROUND OF THE INVENTION

Field of the Invention

The present invention relates to an integrated remote control device and a computer readable recording medium storing a remote controlling method using the same.

Description of Related Art

A remote control is a device which controls a remotely positioned electronic device through a wireless communication, and a user uses a plurality of remote controls according to types and brands of electronic devices that the user has. The remote control increases the ease of use because a user can control various functions of electronic devices at a remote location. However, the remote control may bring a number of troubles in a case that the user has a plurality of electronic devices because the user searches all the remote controls to find out the remote control corresponding to a control object.

Accordingly, use of an integrated remote control increases to control a plurality of electronic devices using one remote control.

Korean patent No. 10-1601109 (hereinafter, it will be called a "prior art 1") discloses an integrated remote controller that points to an electronic device that is a control object among a plurality of electronic devices and controls the electronic device of the control object. Korean patent No. 10-1583831 (hereinafter, it will be called a "prior art 2") discloses an integrated remote control that selects a convenience device that is a control object among a plurality of convenience devices using angular speed of a MEMS (Micro-Electro-Mechanical System) gyroscope.

According to the prior art 1 and the prior art 2, only a predetermined control object can be controlled based on a pre-stored control program but it is hard to control a newly-added control object. In order to control a newly-added control object, a control program corresponding thereto should be newly installed. Therefore, it is quite cumbersome to use.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an integrated remote control device and a computer readable recording medium storing a remote controlling method using the same having advantages of wirelessly controlling a plurality of control objects.

Various aspects of the present invention are directed to providing an integrated remote control device and a computer readable recording medium storing a remote controlling method using the same having further advantages of coupling and decoupling a function module corresponding to a control object.

In addition to the object, an exemplary embodiment of the present invention may be used to accomplish other objects which are not mentioned specifically.

An integrated remote control device according to an exemplary embodiment of the present invention may include: a control object receiver for receiving an identification information related to a control object; a control command receiver for receiving a common control command; a control code storage for storing the identification information and a control code of a plurality of control objects; a control command converter for converting the received common control command into an individual control command based on the received identification information related to the control object; and a control command outputting portion for outputting the converted individual control command through a wireless communication network.

The control object receiver may receive the identification information related to the control object through at least one function module enabling of being coupled to or being decoupled from the integrated remote control device.

The control command receiver may receive the common control command through a jog wheel module coupled to the integrated remote control device.

The control code storage may receive and store the identification information and the control code of the control object from a user terminal or a server corresponding to the control object.

The control command converter may search the control code corresponding to the received identification information related to the control object among the control codes stored in the control code storage, and convert the common control command into the individual control command based on the searched control code.

An integrated remote control device according to another exemplary embodiment of the present invention may include: a bottom module accommodating a battery; a control module positioned above the bottom module and including a first printed circuit board (PCB) and a second PCB; a supporting module positioned above the control module and including at least one receiving recess; and a function module positioned above the supporting module and including at least one unit module corresponding to a plurality of control objects, wherein the unit module is fitted into the receiving recess to contact with the first PCB.

The supporting module may include a jog wheel module contacting with the second PCB.

The integrated remote control device may further include a cover module positioned above the supporting module and indicating an indicator tube for indicating the selected unit module.

A computer readable recording medium according to another exemplary embodiment of the present invention may record program instructions for executing a remote controlling method through an integrated remote control device. The computer readable recording medium may include: program instructions for storing an identification information and a control code of a plurality of control objects; program instructions for receiving the identification information related to the control object; program instructions for receiving a common control command; program instructions for converting the received common control command into an individual control command based on the received identification information related to the control object; and program instructions for outputting the converted individual control command through a wireless communication network.

The program instructions for storing the identification information and the control code may be configured to receive and store the identification information and the control code of the control object from a user terminal or a server corresponding to the control object.

The program instructions for converting the received common control command into the individual control command may include: program instructions for searching the control code corresponding to the received identification information related to the control object among the stored control codes; and program instructions for converting the common control command into the individual control command based on the searched control code.

According to an exemplary embodiment of the present invention, a user can control a plurality of electronic devices positioned at home or in a vehicle using one remote control device. In a case that a new electronic device is purchased, a control object is added by coupling a function module corresponding to the new electronic device to a remote control device. In a case that an electronic device is discarded, a function module corresponding to the electronic device is decoupled from the remote control device. Therefore, a remote control device may be efficiently managed.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
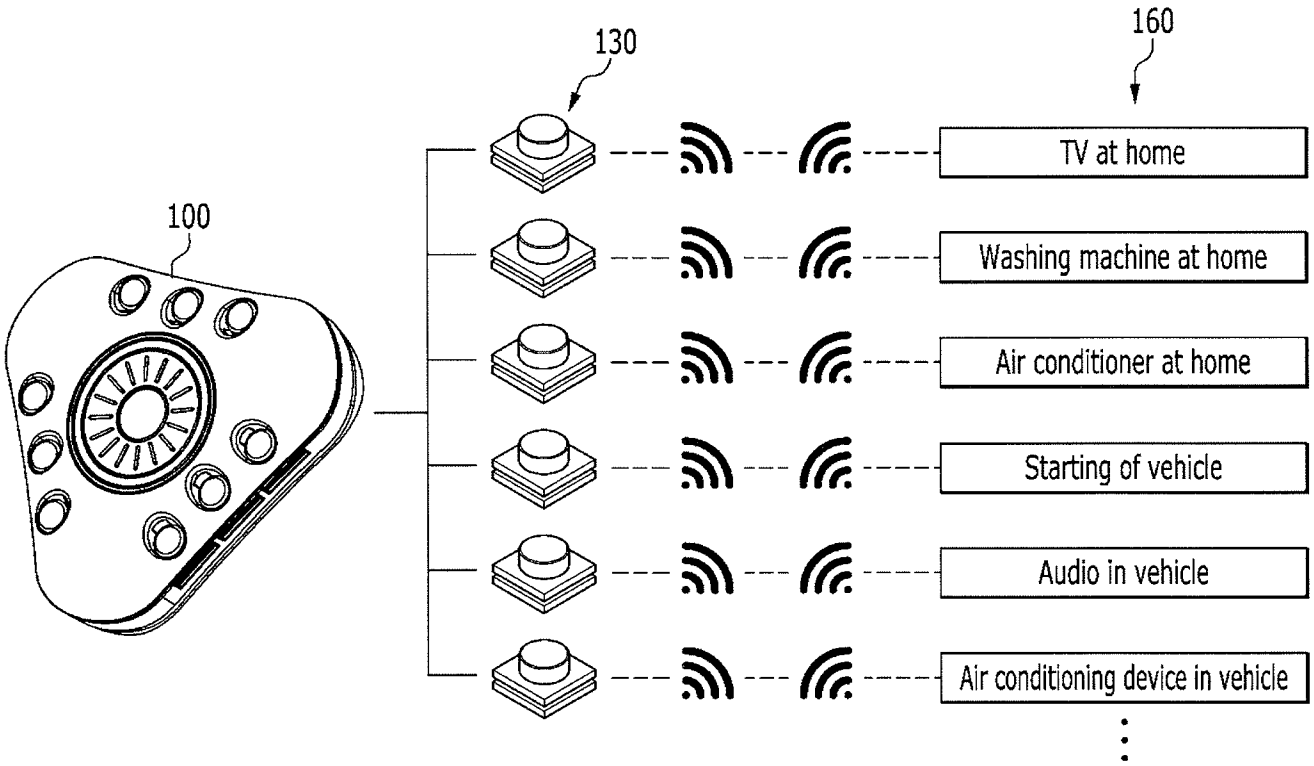
FIG. 1 is a diagram briefly illustrating use of an integrated remote control device according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

It will be further understood, unless it is explicitly described to the contrary, that the terms "comprises", "includes", "including" and/or "comprising," when used in the present specification, specify the presence of stated features, integers, steps, operations, elements, and/or components, but do not preclude the presence or addition of one or more other features, integers, steps, operations, elements, components, and/or groups thereof. In addition, if it is mentioned that one feature is disposed "above" another feature, this means the one feature is disposed just above another feature or is disposed above another feature with other feature being disposed therebetween. On the contrary, if it is mentioned that one feature is disposed "just above" another feature, other feature is not disposed between the one feature and another feature.

The terminology such as " . . . portion", "module", etc. in the specification means a unit which processes at least one function or one operation, and this can be embodied by a combination of hardware or software or hardware and software.

In the present specification, "electronic devices" are disposed at home or in a vehicle and can be remotely controlled through a wireless communication module. For example, the electronic devices include set-top boxes, home cinemas, air conditioners, TVs, DVDs, IPTVs, cameras, cleaners, fans, washing machine, drying machine, boilers, audios, lighting equipment, and etc.

FIG. 1 is a diagram briefly illustrating use of an integrated remote control device according to an exemplary embodiment of the present invention.

As shown in FIG. 1, an integrated remote control device 100 according to an exemplary embodiment of the present invention includes at least one function module 130, and can control operation of electronic devices positioned at home or in a vehicle through individual function modules 130. At this time, the electronic devices positioned at home or in the vehicle can receive control signals through different bandwidth. For example, the integrated remote control device 100 can control power, volume, channel, brightness, etc. of a TV positioned at home through a first function module, and control power, wind speed, temperature, etc. of an air conditioning system positioned in the vehicle through a second function module.

The function module of the integrated remote control device 100 illustrated in FIG. 1 includes an identification information related to the electronic device that is a control object 160. Here, the identification information includes a manufacturer and a model name of the electronic device.

Figure 2:
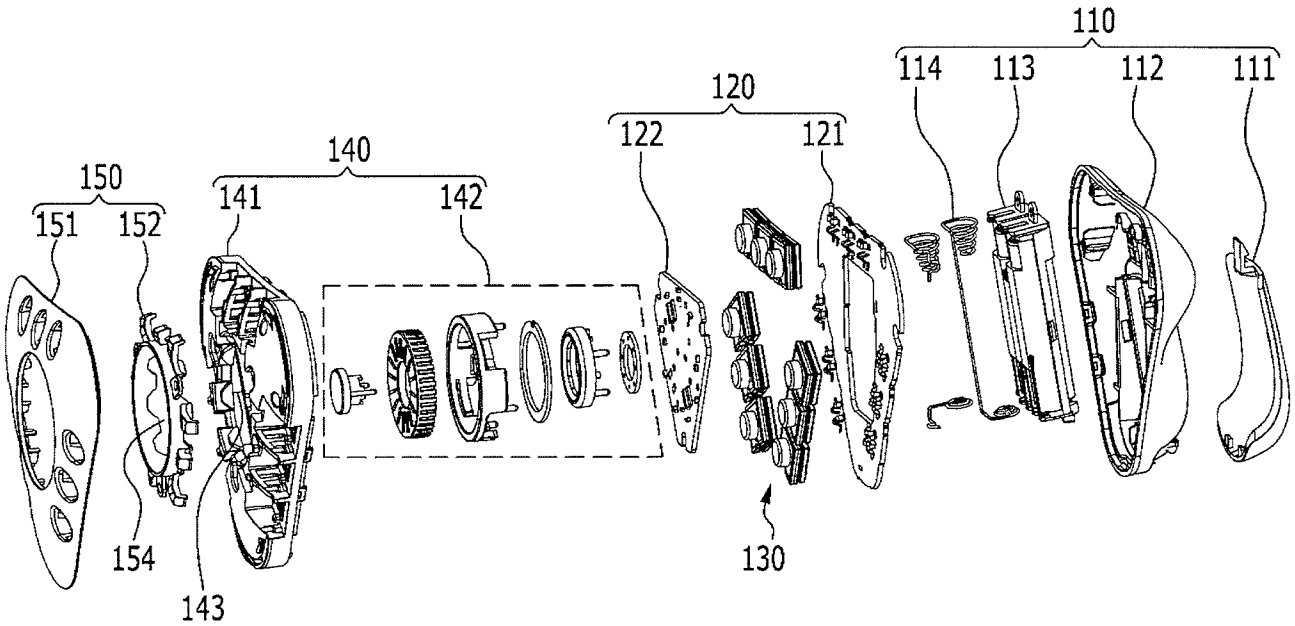
FIG. 2 is an exploded perspective view of an integrated remote control device according to an exemplary embodiment of the present invention.

FIG. 2 is an exploded perspective view of an integrated remote control device according to an exemplary embodiment of the present invention.

As shown in FIG. 2, the integrated remote control device 100 includes a bottom module 110, a control module 120, the function module 130, a supporting module 140 and a cover module 150.

The bottom module 110 accommodates a battery and supports an assembly including the control module 120, the function module 130, the supporting module 140 and the cover module 150.

The bottom module 110 includes a battery cover 111, a bottom cover 112, a battery room 113 and a battery terminal 114. In detail, the battery cover 111 is detachably coupled to the bottom cover 112 and the battery room 113 accommodating the battery is disposed in the bottom cover 112. In addition, the battery terminal 114 electrically connects the battery in the battery room 113 to the control module 120 to supply power of the battery to the control module 120.

The control module 120 is positioned above the bottom module 110 and includes a first printed circuit board (PCB) 121 and a second PCB 122. In detail, the first PCB 121 can contacts with a terminal of each function module 130 to receive the control object 160 that each function module 130 is in charge of, and the second PCB 122 can contacts with a terminal of a jog wheel module 142 to receive a control command input through the jog wheel module 142. When the second PCB 122 receives the control command, the control command is converted into a suitable command according to the control object 160 received by the first PCB and the suitable command is output.

The function module 130 is positioned above the control module 120 and contacts with the first PCB 121. In detail, the function module 130 includes a plurality of unit modules 130-1, 130-2, and 130-3 corresponding to a plurality of control objects 160, and each unit module is detachably mounted at the supporting module 140. A shape and coupling structure with the supporting module 140 of each unit module will be described in detail with reference to FIG. 4.

The supporting module 140 is positioned above the control module 120 and includes a first top cover 141 and the jog wheel module 142. In detail, the first top cover 141 includes a plurality of receiving recesses 141-1, 141-2, and 141-3 into which the plurality of unit modules 130-1, 130-2, and 130-3 positioned on the first PCB 121 is inserted and a first penetration hole 143 into which the jog wheel module 142 is inserted. In addition, the jog wheel module 142 is positioned in the first penetration hole 143 of the first top cover 141, contacts with the second PCB 122, and includes a jog wheel and a button. Since the jog wheel module 142 is well-known to a person of an ordinary skill in the art, detailed description thereof will be omitted.

The cover module 150 includes a second top cover 151 positioned above the first top cover 141 and an indicator tube 152. In detail, second top cover 151 corresponds to the first top cover 141 and includes a plurality of insertion holes 151-1, 151-2, and 151-3 into which the plurality of unit modules is inserted and a second penetration hole 153 into which the jog wheel module 142 is inserted. In addition, the indicator tube 152 is positioned between the first top cover 141 and the second top cover 151 and indicates the unit module selected as the control object by a user among the plurality of unit modules 130-1, 130-2, and 130-3 included in the function module 130. At this time, the indicator tube 152 includes a third penetration hole into which the jog wheel module 142 is inserted and light emitting diode (LED) lightings 155 extending from the third penetration hole 154 toward the plurality of unit modules.

Figure 3:
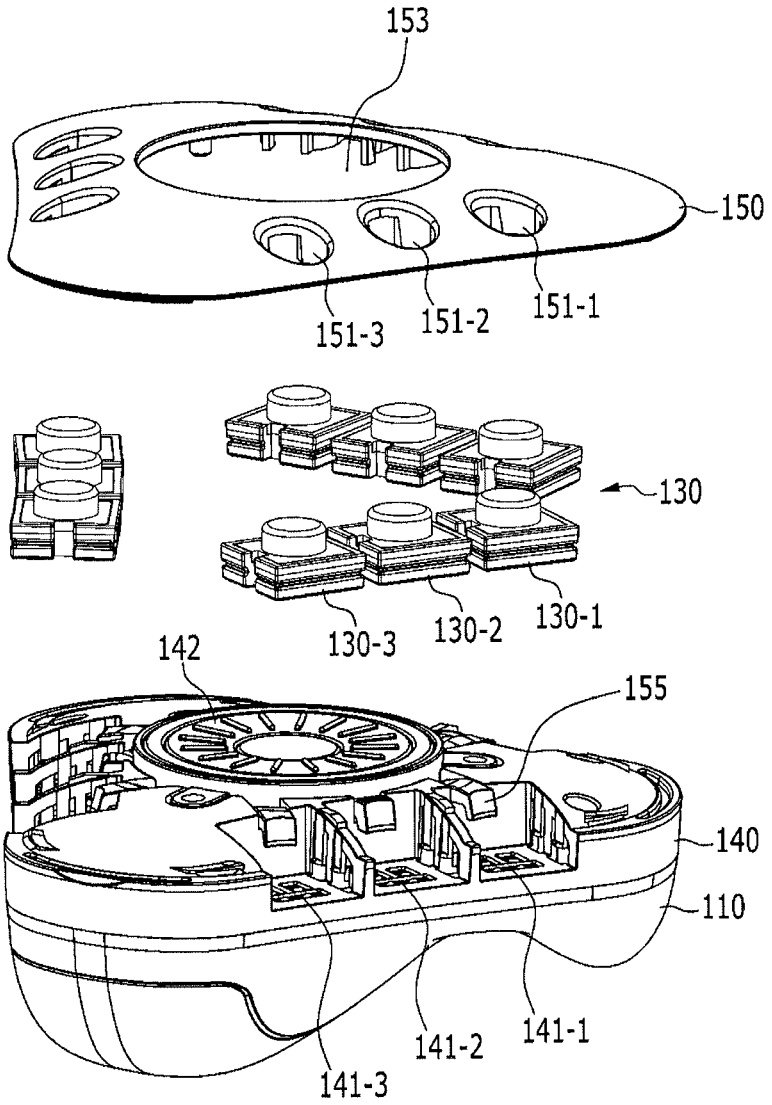
FIG. 3 is an exploded assembly view of an integrated remote control device according to an exemplary embodiment of the present invention.

FIG. 3 is an exploded assembly view of an integrated remote control device according to an exemplary embodiment of the present invention.

As shown in FIG. 3, the bottom module 110 accommodates the control module 120 and the battery, and the supporting module 140 is assembled on the bottom module 110.

As shown in FIG. 3, the function module 130 and the cover module 150 are assembled on the supporting module 140. In detail, the unit modules 130-1, 130-2, and 130-3 are fitted respectively into the receiving recesses 141-1, 141-2, and 141-3 of the first top cover 141, and the cover module 150 is coupled on the first top cover 141. At this time, a top portion of each unit module 130-1, 130-2, or 130-3 fitted into the corresponding receiving recess 141-1, 141-2, or 141-3 of the supporting module 140 protrudes through the corresponding receiving recess 151-1, 151-2, or 151-3 of the second top cover 151. Therefore, the user can identify the unit modules 130-1, 130-2, and 130-3 of the integrated remote control device.

Figure 4:
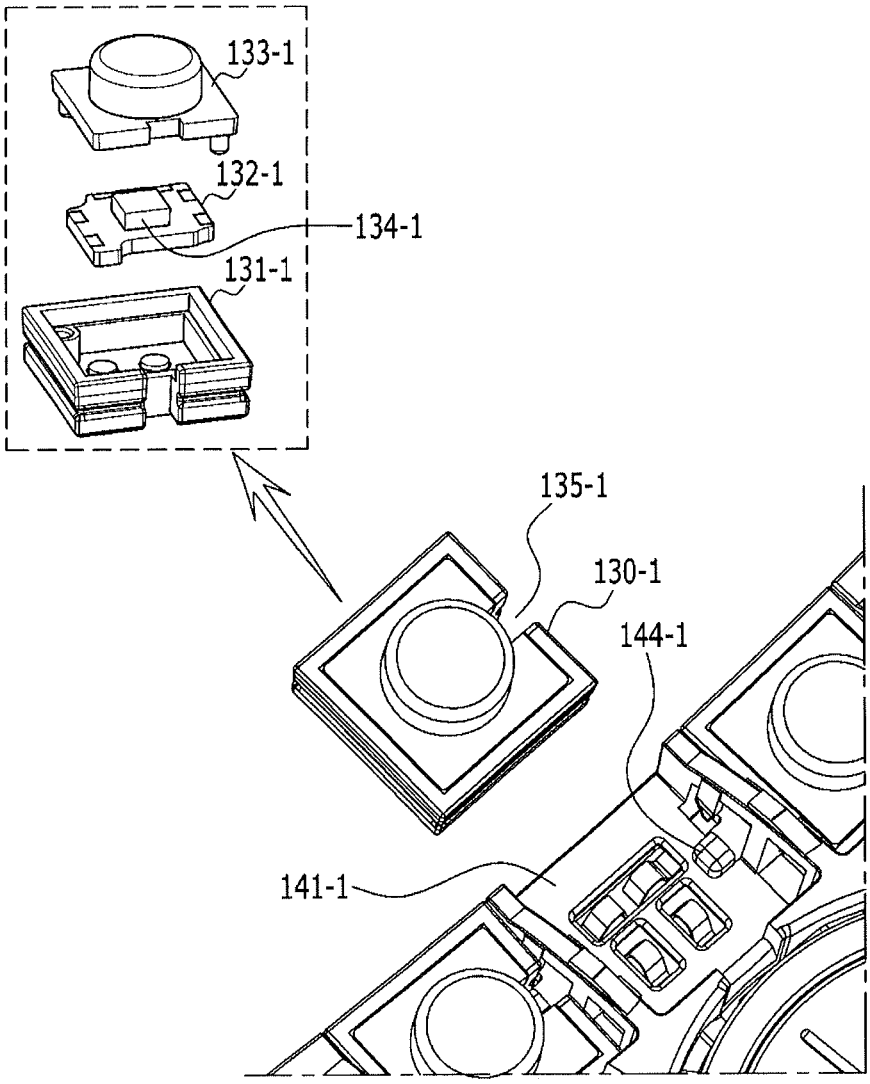
FIG. 4 is an exploded perspective view of a unit module according to an exemplary embodiment of the present invention.

FIG. 4 is an exploded perspective view of a unit module according to an exemplary embodiment of the present invention.

As shown in FIG. 4, the unit module 130-1 includes a frame 131-1 corresponding to the receiving recess of the first top cover 141, a contact portion 132-1 disposed inside the frame 131-1 and including a button 134-1, and a protection cover 133-1 positioned above the contact portion 132-1 and protecting the contact portion 132-1. At this time, the unit module 130-1 is coupled to the first top cover 141 by use of a protrusion 144-1 formed at one side of the receiving recess 141-1 of the first top cover 141 and a recess 135-1 corresponding to the protrusion 144-1 and formed at the frame 131-1.

According to the exemplary embodiment of the present invention, when the user presses the button 134-1 of the contact portion 132-1 through the protection cover 133-1, electric signal is transmitted to the first PCB 121 to designate the control object 160. In addition, the unit module 130-1 can be easily and simply assembled to the integrated remote control device by use of the protrusion 144-1 of the first top cover 141 and the recess 135-1 of the frame 131-1.

It is illustrated in FIG. 2, FIG. 3 and to FIG. 4 that a shape of the unit module is quadrangle and the number of the unit modules are nine. However, the shape and the number of unit modules are not limited to this and may be changed in various ways.

Figure 5:
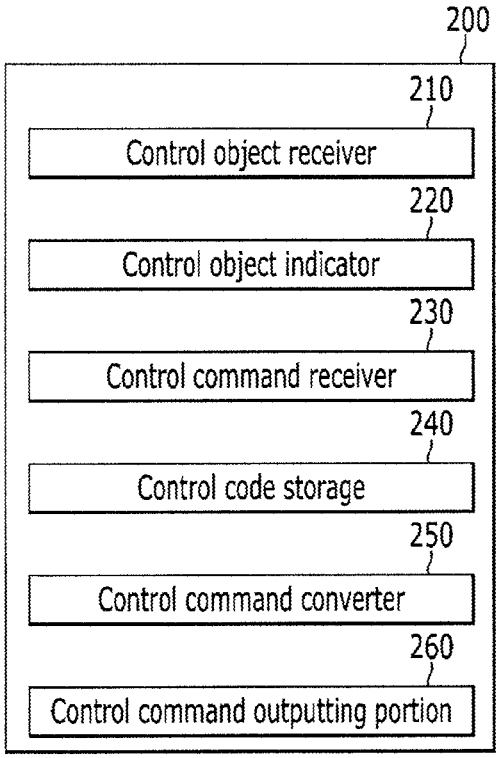
FIG. 5 is a block diagram of an integrated remote control device according to an exemplary embodiment of the present invention.

FIG. 5 is a block diagram of an integrated remote control device according to an exemplary embodiment of the present invention.

As shown in FIG. 5, the integrated remote control device 200 includes a control object receiver 210, a control object indicator 220, a control command receiver 230, a control code storage 240, a control command converter 250, and a control command outputting portion 260.

The control object receiver 210 receives the control object 160 transmitted through the user's manipulation of the unit module. Here, the unit module includes the identification information on the electronic device 160 that is the control object.

The control object indicator 220 indicates the unit module corresponding to the control object 160 received through the control object receiver 210. For example, the LED lighting 155 connected to the unit module emit light to indicate that the corresponding unit module is selected.

The control command receiver 230 receives a common control command transmitted through the user's manipulation of the jog wheel module 142. Here, the common control command is generated by manipulation including a rotating direction and rotating angle of the jog wheel and on/off of the button, and means a control command for controlling power, a channel, temperature, brightness, volume, wind speed, mode switch and play/stop of the electronic device.

The control code storage 240 stores the identification information and a control code of the electronic device. The control code storage 240 according to the exemplary embodiment of the present invention receives and stores the identification information and the control code of the electronic device transmitted from a user terminal and a server of manufacturer of the electronic device through a wireless communication network. For example, the control code storage 240 receives and stores the identification information and the control code of the electronic device from the user terminal. At this time, the control code includes the identification information and the control code corresponding to the electronic device which the user has. In addition, the identification information and the control code of the electronic device transmitted from a plurality of servers of the manufacturers of the electronic devices. At this time, the control code includes the identification information and the control codes corresponding to all the electronic devices which are manufactured by the manufacturers.

The control command converter 250 converts the common control command received through the control command receiver 230 into an individual control command corresponding to the control object received through the control object receiver 210. In detail, when the control object and the control command are received, the control code corresponding to the identification information related to the control object among the control codes stored in the control code storage 240 is searched, and the common control command is converted into the individual control command based on the searched control code.

The control command converter 250 according to the exemplary embodiment of the present invention outputs a warning when the control code corresponding to the received control object among the control codes stored in the control code storage 240 is not searched. For example, the indicator tube operates all the LED lightings 155 simultaneously to give the warning to the user.

The control command outputting portion 260 outputs the individual control command converted by the control command converter 250. At this time, the control command outputting portion 260 may output the individual control command through a short-range wireless communication including Bluetooth, IrDA, Zigbee, WiFi, etc.

For example, when a first common control command for the control object A is received, the first common control command is converted into a first individual control command corresponding to the control object A and the converted first individual control command is output through a first frequency range according to the exemplary embodiment of the present invention. In addition, a first common control command for the control object B is received, the first common control command is converted into a second individual control command corresponding to the control object B and the converted second individual control command is output through a second frequency range.

Figure 6:
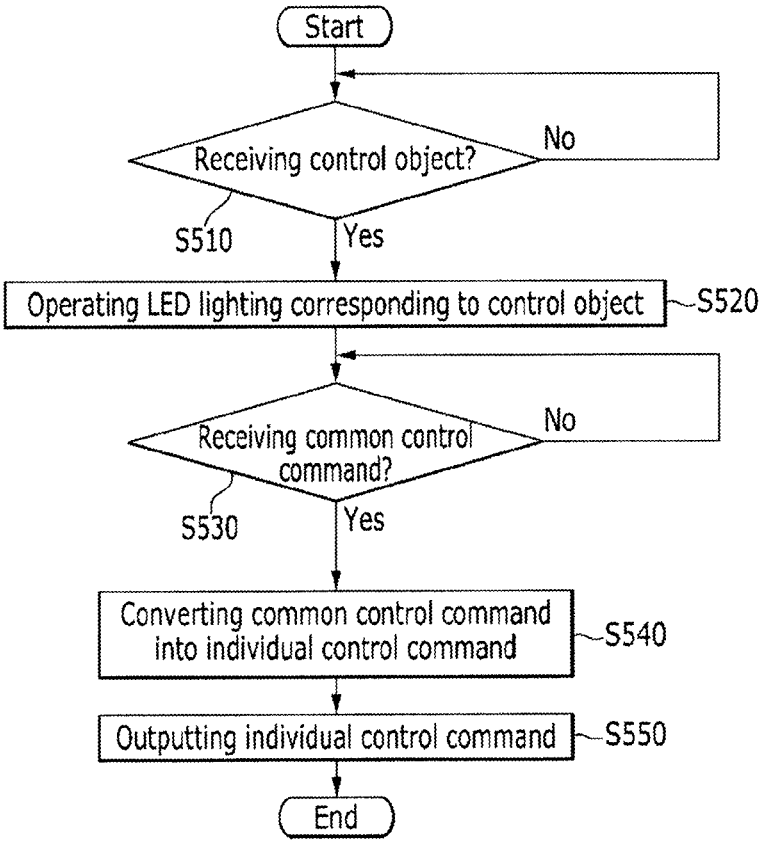
FIG. 6 is a remote controlling method using an integrated remote control device according to an exemplary embodiment of the present invention.

FIG. 6 is a remote controlling method using an integrated remote control device according to an exemplary embodiment of the present invention.

Firstly, the control object receiver 210 receives the control object corresponding to the unit module which is manipulated by the user at step S510.

After that, the control object (corresponding to the unit module) is indicated at step S520 by operating the LED lighting 155 that correspond to the unit module manipulated by the user at the step S10.

After that, the control command receiver 230 receives the common control command generated by the user's manipulation of the jog wheel module at step S530. At the step S530, the common control command corresponding to the user's manipulation of the jog wheel and the button is received.

When the common control command is received at the step S530, at step S540, the control command converter 250 converts the common control command into the individual control command corresponding to the control object received at the step S510.

After that, the control command outputting portion 260 outputs the individual control command converted at the step S540 through a short-range communication network.

According to the exemplary embodiment of the present invention, in a case that a new electronic device is purchased, the function module corresponding to the purchased electronic device is added into the integrated remote control device and the corresponding electronic device can be controlled without purchasing an additional remote control.

According to the exemplary embodiment of the present invention, since the function modules corresponding to the electronic devices that a user often uses can be added into the integrated remote control device and function modules are disposed considering types and frequency of use of the electronic devices and hands and fingers that the user often uses, manipulation convenience of the user can be improved.

A remote controlling method according to an exemplary embodiment of the present invention can be disposed in the control module as programs, and the programs includes program instructions for storing the identification information and the control code of the control object, program instructions for receiving the identification information related to the control object, program instructions for receiving the common control command, program instructions for converting the received common control command into the individual control command based on the received identification information related to the control object, and program instructions for outputting the converted individual control command through the short-range wireless communication network.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An integrated remote controller, comprising:

a control object receiver for receiving an identification information related to a control object;

a control command receiver for receiving a common control command;

a control code storage for storing identification information list including a plurality of identification information and a control code of a plurality of control objects;

a control command converter for converting the received common control command into an individual control command based on the received identification information related to the control object; and a control command outputting portion for outputting the converted individual control command through a wireless communication network, wherein the control object receiver receives the identification information related to the control object through at least one function module enabling of being coupled to or being decoupled from the integrated remote controller, and wherein each function module stores therein the identification information related to each control object.

2. The integrated remote controller of claim 1, wherein the control command receiver receives the common control command through a jog wheel module coupled to the integrated remote controller.

3. The integrated remote controller of claim 1, wherein the control code storage receives and is configured to store the identification information list and the control code of the control object from a user terminal or a server corresponding to the control object.

4. The integrated remote controller of claim 1, wherein the control command converter searches the control code corresponding to the received identification information related to the control object among control codes stored in the control code storage, and converts the common control command into the individual control command based on the searched control code.

5. An integrated remote controller, comprising:

a bottom module accommodating a battery;

a control module disposed above the bottom module and including a first printed circuit board (PCB) and a second PCB;

a supporting module disposed above the control module and including at least one receiving recess; and a function module disposed above the supporting module and including at least one unit module corresponding to a plurality of control objects, wherein the unit module is fitted into the receiving recess to contact with the first PCB.

6. The integrated remote controller of claim 5, wherein the supporting module includes a jog wheel module contacting with the second PCB.

7. The integrated remote controller of claim 5, further including a cover module disposed above the supporting module and indicating an indicator tube for indicating the selected unit module.

8. A non-transitory computer readable recording medium which records program instructions for executing a remote controlling method through an integrated remote controller, the computer readable recording medium comprising:

program instructions for storing an identification information list including a plurality of identification information, and a control code of a plurality of control objects;

program instructions for receiving an identification information related to the control object from at least one function module enabling of being coupled to or being decoupled from the integrated remote controller, wherein each function module stores therein the identification information related to each control object;

program instructions for receiving a common control command;

program instructions for converting the received common control command into an individual control command based on the received identification information related to the control object; and program instructions for outputting the converted individual control command through a wireless communication network.

9. The non-transitory computer readable recording medium of claim 8, wherein the program instructions for storing the identification information list and the control code is configured to receive and store the identification information list and the control code of the control object from a user terminal or a server corresponding to the control object.

10. The non-transitory computer readable recording medium of claim 8, wherein the program instructions for converting the received common control command into the individual control command includes:

program instructions for searching the control code corresponding to the received identification information related to the control object among stored control codes; and program instructions for converting the common control command into the individual control command based on the searched control code.

* * * * *